US005477977A

United States Patent [19]

Cudzik

[11] Patent Number: 5,477,977

[45] Date of Patent: Dec. 26, 1995

[54] THIN-WALLED CAN HAVING A NESTABLE/STACKABLE BOTTOM SUPPORT RING

[75] Inventor: Daniel F. Cudzik, Chesterfield County, Va.

[73] Assignee: Reynolds Metals Company, Richmond, Va.

[21] Appl. No.: 238,556

[22] Filed: May 5, 1994

[51] Int. Cl.[6] ..... B65D 25/26

[52] U.S. Cl. ..... 220/636; 220/632; 220/605; 220/906

[58] Field of Search ..... 220/212, 626, 220/628, 632, 636, 635, 605, 906, 902; 206/501, 509, 821

[56] References Cited

U.S. PATENT DOCUMENTS

| | | | |
|---|---|---|---|
| 2,018,271 | 10/1935 | Lewis | 220/632 |
| 2,641,426 | 6/1953 | Rauscher | 220/632 |
| 2,847,144 | 8/1958 | Cornelius | 220/632 |
| 2,957,601 | 10/1960 | Novick | 206/821 |
| 3,158,296 | 11/1964 | Cornelius | 220/632 |
| 3,180,537 | 4/1965 | Collins | 206/821 |
| 3,202,448 | 8/1965 | Stern et al. | 206/151 |
| 3,390,807 | 7/1968 | Cornelius | 220/632 |
| 3,446,346 | 5/1969 | Burge | 206/151 |
| 3,616,032 | 10/1971 | Kugler | 220/628 |
| 3,638,826 | 2/1972 | Barker et al. | 220/632 |
| 3,650,395 | 3/1972 | Hobbs | 206/402 |
| 3,653,504 | 4/1972 | Saumsiegle | 206/181 |
| 3,757,983 | 9/1973 | McCarthy | 220/402 |
| 3,799,423 | 3/1974 | Cvacho | 220/634 |
| 3,838,789 | 10/1974 | Cvacho | 220/634 |
| 3,963,226 | 6/1976 | Jankowski | 220/632 |
| 4,177,746 | 12/1979 | Lee, Jr. et al. . | |
| 4,222,494 | 9/1980 | Lee, Jr. et al. . | |
| 4,513,875 | 4/1985 | Kuehn, Sr. | 220/628 |
| 4,591,066 | 5/1986 | Moen | 220/634 |
| 4,593,818 | 6/1986 | Schenkman | 206/821 |
| 4,722,215 | 2/1988 | Taube et al. . | |
| 4,767,015 | 8/1988 | Ho | 220/632 |
| 4,781,047 | 11/1988 | Bressan et al. . | |
| 4,885,924 | 12/1989 | Claydon et al. . | |
| 4,940,137 | 7/1990 | Straub | 206/139 |
| 5,105,964 | 4/1992 | Heath | 220/254 |
| 5,105,973 | 4/1992 | Jentzsch et al. . | |
| 5,154,289 | 10/1992 | Van Erden | 206/432 |

FOREIGN PATENT DOCUMENTS

| | | | |
|---|---|---|---|
| 0555192 | 8/1923 | France | 220/632 |
| 1362619 | 4/1964 | France | 206/821 |
| 1184694 | 12/1964 | Germany | 220/632 |
| 3937085 | 5/1990 | Germany | 220/632 |

OTHER PUBLICATIONS

Websters Dictionary, p. 609, Definition of Parallelogram Date Jan. 1956.

The Canmaker, Mar. 1993, "The New Reformation", pp. 45–48.

*Primary Examiner*—Stephen J. Castellano

*Attorney, Agent, or Firm*—Robert C. Lyne, Jr.

[57] ABSTRACT

A thin-walled metal container is formed with a bottom wall which is substantially flat and connected to a container side wall through a curved wall portion located at the periphery of the flat bottom wall. A stacking support member is attached to the lower surface of the bottom wall to define a rest surface for supporting the container on a horizontal surface, The stacking support member is made of foam material to prevent 'sweating' of the container on a table surface while also minimizing scratching, Other non-metallic materials may function as the stacking support member.

18 Claims, 3 Drawing Sheets

THIN-WALLED CAN HAVING A NESTABLE/STACKABLE BOTTOM SUPPORT RING

TECHNICAL FIELD

The present invention relates to thin-walled metal cans having a cylindrical side wall and a bottom integral therewith, and, more particularly, to configurations of such can bottoms.

BACKGROUND ART

Today's market for metal beverage cans is extremely price competitive, which necessitates making the cans from the least amount of metal possible while still providing the necessary structural integrity. By using state of the art manufacturing techniques it is now possible to manufacture a 12 ounce aluminum can having a thin side wall, e.g., about 0.0040–0.0045 inch thick, with the side wall increasing in thickness at its upper end to about 0.0070–0.0075 inch to permit the forming of a can neck without collapsing or wrinkling the side wall. New necking processes are expected to yield metal and cost reduction in the neck region of the can. An example of such a process is the spin flow process disclosed fin U.S. patent application Ser. No. 07/929,932, filed Aug. 14, 1992 and issued to the present assignee, Reynolds Metals Company. U.S. Pat. No. 4,781,047 issued to Ball Corporation also pertains to a spin flow process.

Notwithstanding the technological advances which have resulted in metal savings in the neck region of the can, the can bottom continues to be manufactured with a thickness of about 0.012 inch, which means that about one-third of the weight of the metal in the can must be in the bottom to provide the necessary structural integrity. The can bottom must be able to sustain a column load of approximately 250 pounds during a spin flow necking process and 300 pounds during a die necking process. Later, it must sustain a column load of about 135 pounds when a can end is double-seamed on the can body after it has been filled with product. Another design criterion is a drop test for shock loads, in which the filled and seamed can must be able to resist a drop of about five inches. In addition, a can filled with a carbonated beverage must be able to contain an internal pressure of about 40–100 psi. Of course, the can bottom must also be capable of stably supporting the can on a flat surface, while having the ability to nest against the seamed end of an adjacent below can in stacking relationship.

To meet these requirements, conventional industry practice is to form the relatively thick bottom to have a profile with a concave or hollow central region. The bottom is formed into its final, inwardly domed shape between a hollow die engaging the internal surface of the bottom from the interior of the can and a punch engaging the external surface of the bottom. Cooperation of the punch and die creates a bottom having an inner wall at the outside of the concave region, an outer wall, and a rest radius connecting these two walls.

The resistance of the inwardly domed portion to outward bulging under internal pressure is greatly influenced by the size of the rest radius. The smaller the rest radius, generally the higher the internal pressure resistance of the can. Too large a radius will reduce this pressure to an unacceptable level. However, this conventional forming process works best if the rest radius is large, because during the process the sheet metal is pulled radially inwardly into the hollow region and, as viewed in profile, snakes around the radius on the punch and die. Too small a radius will create a fracture or thickness reduction. Thus, these two competing factors require compromise. Although advances are presently being made by the present assignee and others to reduce the rest radius of can bottoms to increase their bulge strength and thereby reduce their thickness, this approach inherently requires that the overall strength of the can bottom is dictated by mechanical features in the bottom.

U.S. Pat. No. 5,105,973, which issued Apr. 21, 1992 to Ball Corporation, contains a comprehensive discussion of inwardly domed can bottoms and the phenomena of dome reversal and roll-out (i.e, unrolling of inward profiles) caused by internal pressure, increases in overall can height resulting from this type of failure, and ways to strengthen inwardly domed can bottoms without unacceptably decreasing the internal volume of the can. See also U.S. Pat. No. 4,222,215 and No. 4,885,924 issued to Metal Box p. l. c., which concern reforming inwardly domed can bottoms in an additional operation, and U.S. Pat. No. 4,177,746 and No. 4,222,494 issued to Reynolds Metals Company, the assignee hereof. Inwardly domed can bottoms will not be discussed further herein, since the present invention preferably does not employ an inwardly domed can bottom and is intended to be an alternative to that approach. However, the present invention, as will be seen below, may be used in conjunction with an inwardly domed can bottom.

It is an object of the present invention to reduce she thickness of the metal in a can bottom without affecting the structural integrity of the can.

Another object is to reduce the metal in the can bottom to a thickness of approximately 0.0070 inch to thereby reduce its weight by approximately 30% while still enabling the can to satisfy design requirements.

Yet a further object of the invention is to provide a can bottom formed without inwardly curved mechanical features.

A further object is to provide a can bottom wherein the tensile strength of the metal provides sufficient strength satisfy the design requirements.

SUMMARY OF THE INVENTION

For clarity and consistency, some of the terms used in the specification and the claims hereof will now be defined. "Can" and "container" are used interchangeably. "Can end" or "lid" means a closure which is, or is intended to be, affixed to a can body containing a product. When the product is a beverage, the can end and can body are typically sealed together at a circular double-seam. Directional terms such as "upper", "lower", "side", horizontal", and "vertical" refer to cans, can bodies, and can ends as though they are resting upright on a horizontal table. It will be understood, however, that the can bodies may be, and probably will be, in different orientations as they are being manufactured. "Axis" and "axial" refer to the longitudinal axis of the can body, and "radial" and "radially" relate to that axis. "Profile" means the profile of a can end or can body as viewed in a cross-section taken along its longitudinal (vertical) axis. "Radius" refers to a curve in the profile of the can body. The "rest surface" of a can body is the line or area at its very bottom which contacts a horizontal surface when the can body is resting upright on the surface.

A metal container, according to the present invention, comprises a bottom wall and a cylindrical side wall extending substantially axially from the bottom wall to define an open end which is adapted to be closed with a can end seamed onto the open end. A stacking support member is attached to the bottom wall to define the rest surface for supporting the container on a horizontal or like support surface.

In a preferred embodiment of the present invention, the bottom wall is formed without inwardly curved, mechanical features which would be susceptible to unrolling by metal reversal as a result of carbonation pressure within the filled and sealed container. Therefore, the bottom wall, in an unfilled and unpressurized condition, is substantially flat along its entire extent, to the point where it joins an outer curved wall bottom extending radially outward from the bottom wall and then upwardly into the side wall. Since the unique bottom wall construction of this invention is believed to make it possible to utilize a thinner gauge metal, such as 0.006 inch thick, as opposed to a conventionally used metal thickness of 0.012 inch, by virtue of the fact that can supporting surfaces are now formed on a separate stacking support member attached to the bottom wall, there is advantageously achieved a corresponding metal and cost reduction savings.

The stacking support member is preferably made of a non-metallic material formed into a ring-shaped configuration having a bottom rest surface which defines a stable resting platform on which the container may be positioned and supported on a flat horizontal surface. Preferably, this stacking support ring is also formed with a nesting surface dimensioned to nest within a can end of an adjacent below can to achieve a stacking configuration.

The stacking support ring can be made from a variety of different materials which are capable of being secured to the lower surface of the can bottom wall so as to provide necking and stacking support capabilities. By way of example, the stacking support ring may be a material selected from the group consisting of rubber, foam, wood, polyethylene, polypropylene, and paper.

In the preferred embodiment, the stacking support rings are preferably made of a loam material, such as a polystyrene or polyurethane foam. This foam ring can be molded to the can body before or after filling such as through injection molding. The foam ring can also be pre-molded and attached to the can before or after filling with a pressure-sensitive adhesive. Thermal bonding and other types of bonding methods may be practiced.

A further benefit of a foam ring permanently attached to the can bottom wall is that of providing a 'coaster effect' that would prevent the can bottom from 'sweating' on table tops as a result of condensation, or scratching the table surface.

In accordance wish another feature of the invention, the stacking support member may nave an exterior surface which is colored or otherwise treated to have the same appearance as the metal that the container is made of.

In accordance with a further feature of the present invention, a package of metal containers comprises plural metal containers, each container including a bottom wall and a side wall extending substantially axially from the bottom wall to define an open end of the container adapted to be closed with the can end seamed onto the open end. Stacking support members are respectively attached to the container bottom walls to define a rest surface for supporting the container on a horizontal surface. A plurality of webs, preferably formed from the same material as the stacking support members, respectively interconnect adjacent ones of the stacking support members to hold the containers together and define the package. Individual ones of the metal containers can be severed from the package by rupturing the webs connecting the stacking support member of that container to the adjacent stacking support members.

Preferably, the stacking support members and webs are made of a foam material, such as polystyrene or polyurethane. The rings and webs may be jointly formed as a continuous ribbon ring assembly of integral and unitary construction for subsequent or simultaneous attachment to the can bottom walls.

A method of forming a beverage container, in accordance with another aspect of the invention, comprises the steps of forming a metal container with a bottom wall and a side wall extending substantially axially from the bottom wall, and then permanently attaching a stacking support member to define a rest surface for supporting the container on a horizontal surface.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1B:
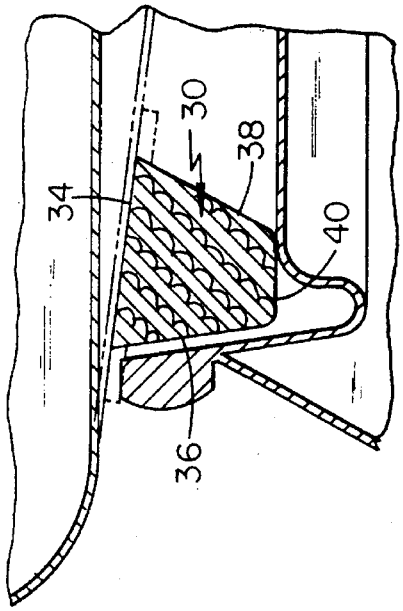
FIGS. 1A and 1B are partial sectional views of stacking support rings respectively made from wood or paper.
Figure 1A:
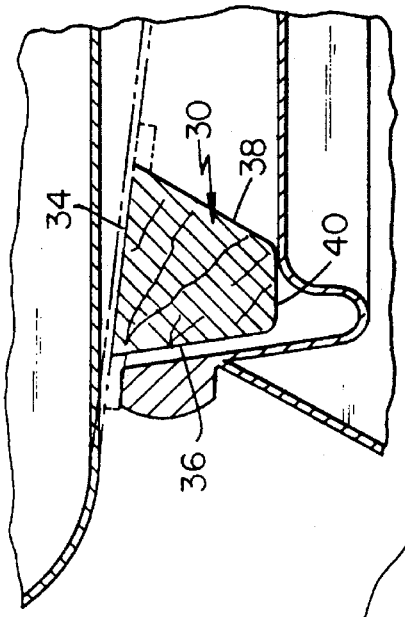
Figure 1:
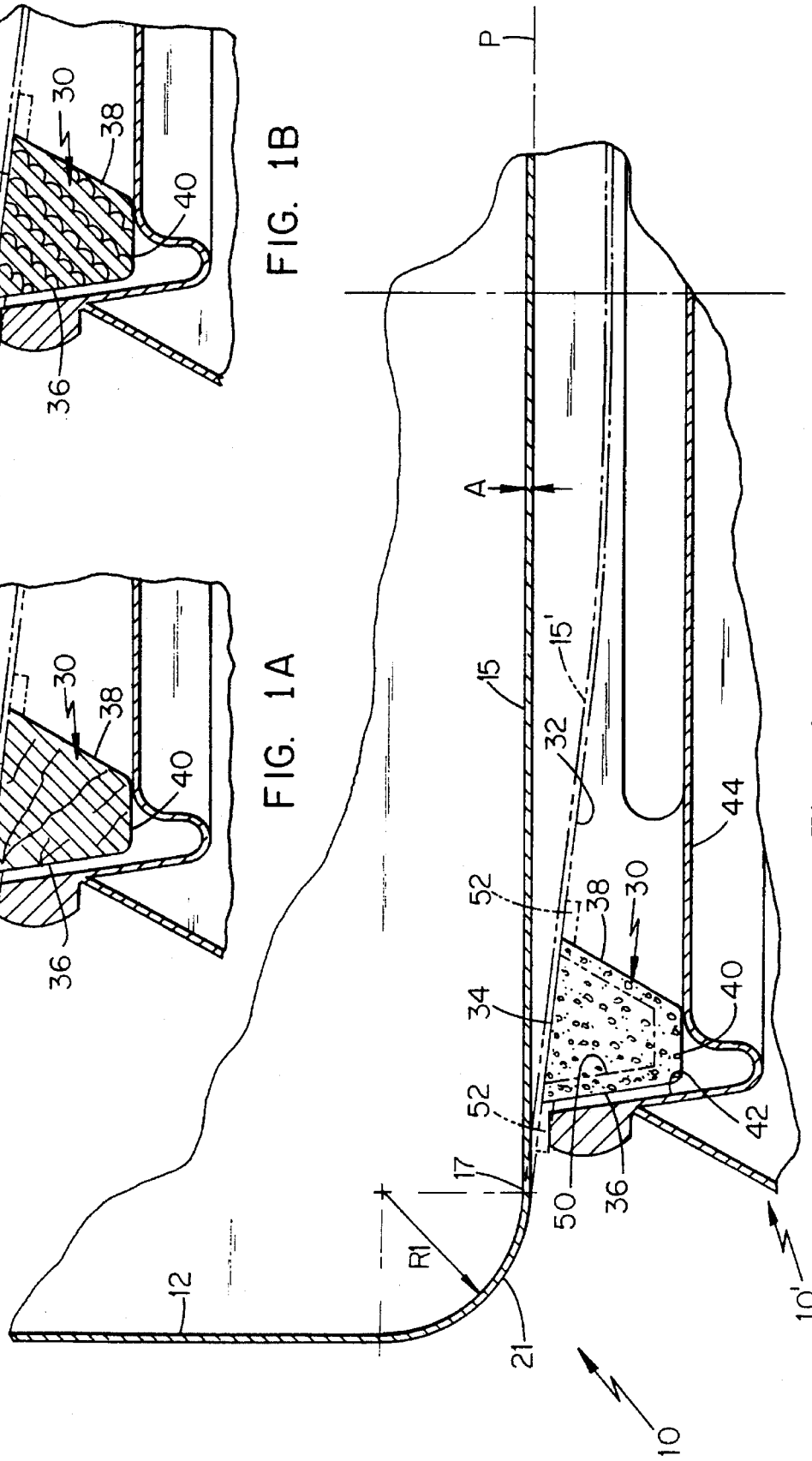
FIG. 1 is a partial sectional view of a preferred embodiment of the present invention.

FIG. 1 is an illustration of a cylindrical, one-piece beverage container body 10 according to the present invention, which preferably has a bottom integral with its side walls and is made of a relatively thin sheet metal material such as aluminum or steel. In the presently preferred embodiment of the invention, container 10 may be a 12 ounce beverage container made from one piece of sheet aluminum having an initial thickness of 0.012 inch. However, it is contemplated that the inventive concepts may be employed in containers made from various materials and with various other dimensions. The foregoing sheet metal is conventionally formed using drawing and ironing equipment, as is well known to one of ordinary skill in the can manufacturing art. This will result in a cylindrical container side wall 12 having a side wall thickness in the range of 0.0004 to 0.0045 inch over most of its height and between 0.0070–0.0075 inches in the upper end portion thereof (not shown) which is adapted to be necked such as in a necking apparatus as disclosed and claimed in either the aforesaid prior application Ser. No. 07/929,932 or U.S. patent application Ser. No. 07/872,484, filed Apr. 23, 1992, which pertains to die necking and is also assigned to Reynolds Metals Company. In accordance with the present invention, container 10 desirably features a relatively thin bottom wall (generally designated with reference numeral 15) having a substantially uniform thickness A of, for example, approximately 0.0060–0.0075 inch, as opposed to conventional thicknesses of 0.012 inch, in the preferred embodiment, the thin bottom wall 15 does not depend upon inwardly curved, mechanical Features for its bulge resistance, so that the physical properties of the metal in the bottom wall 15 are utilized to satisfy design requirements. That is, it is substantially the tensile strength of the metal (e.g., aluminum has a tensile strength of approximately 40,000 psi) which cooperates with the unique form of the bottom wall 15 to provide the container 10 with the necessary structural integrity.

In the presently preferred embodiment of FIG. 1, the container bottom wall 15 is flat along its entire extent and therefore resides in a single plane P when the container 10 is in its unfilled and unpressurized condition. Therefore, this bottom wall 15 is defined by a flat circular portion having a circular periphery 17 connected to an annular curved wall 21 defining the overall periphery of the bottom wall 15. The annular curved wall 21 has a radius of curvature R1 (e.g., R1=0.180 inch) which preferably defines the base radius of the container 10 during filling.

After filling, bottom wall 15 will tend to flex slightly downwardly into a shallow hemispherical shape (depicted with phantom line 15' in FIG. 1) under the carbonation pressure. This deflection from the flat 15 to shallow hemispherical shape 15' will occur approximately as shown. The feature of forming bottom wall 15 of FIG. 1 as a flat member uniquely provides a pressure-resistant configuration wherein the geometry allows the bottom to utilize the tensile strength of the metal to resist seaming and buckling loads, and especially internal pressurization which has resulted in bulging of known container bottom walls as a result of unrolling or reversal of the rest radius in profiled container bottoms.

A can bottom wall 15 having the foregoing flat features in accordance with the present invention advantageously allows the can body 10 to be manufactured by existing drawing and ironing equipment. That is, the can is first drawn to essentially a cylindrical shape as is well known. In the preferred embodiment, base reform tooling need not be operable to impart stacking projections or other features to the can bottom wall which are typically often added during the reforming action.

Since bottom wall 15 in the preferred embodiment of can 10 is formed as a flat member, it is important to provide the can with features establishing stable resting and stacking support capabilities for the can. In accordance with the preferred embodiment of FIG. 1, the can 10 is provided with stacking support capabilities through the provision of a stacking support member 30 preferably permanently attached to the lower surface 32 of the bottom wall 15 such as by injection molding, securement with a pressure-sensitive adhesive, thermal bonding, and other ways which will now occur to one of ordinary skill in the art from a review of this specification. Preferably, the stacking support member 30 is a foam ring which is an inverted trapezoid in cross-sectional shape as best depicted in FIG. 1. Therein, the wider trapezoid base 34 is permanently secured to the lower surface 32 of the bottom wall 15 and the trapezoid sides 36 and 38 extend downwardly from the bottom wall 15 to terminate in the bottom wall 40 of the inverted trapezoidal shape. This bottom wall 40 defines an annular stacking support surface engageable with a horizontal or other support surface to provide stable resting support for the can 10.

Since the container bottom wall 15 will likely flex downwardly from its flat condition to the shallow hemispherical condition 15' after filling and tensioning under carbonation pressure, this displacement may carry the foam ring 30 down with it as depicted in FIG. 1. Optionally, but not necessary to successful practice of the invention, the bottom surface 40 of the trapezoidal section of the foam ring 30 may be formed to lie in a single plane (parallel to plane P) to provide stable resting support when the bottom is displaced to hemispherical condition.

The radially outward side 36 of the trapezoidal section is preferably located at a radial distance from the center of the bottom wall 15 so as to define a nesting surface which will nest so that it is concentric with cylindrical surface 42 of a can end 44 seamed onto a like container 10' located adjacent and below the foam ring 30 to provide stable stacking support for the can 10 as depicted in FIG. 1.

The stacking support member 30 may be formed with other sectional shapes. For example, the support member 30 may have a parallelogram cross-section so that the geometry of the sides thereof will include both a tapered or slanted side providing a nesting surface 36 and a bottom side providing a resting surface 40. Other sections which easily lend themselves to a structure providing both nesting and stacking support may also be utilized.

The foam ring 30 can be molded, such as through injection molding to the can body 10 in an assembly machine before or after filling. The foam ring 30 may also be pre-molded and secured to the lower surface 32 of the can bottom wall 15 with a pressure-sensitive adhesive before or after filling. The foam rings 30 may also be thermally bonded to the can 10 before or after filling.

Another benefit of using a foam ring 30 attached to the bottom 15 of the can 10 is the added benefit of a 'coaster' permanently formed on the can bottom. This advantageously allows the can 10 to avoid sweating on or scratching a table top surface on which it is disposed by the consumer.

Another advantage of utilizing foam in the present invention is that it is essentially a water resistant material that will not be subject to swelling or decomposition, both of which problems may adversely affect the ability of the stacking support member 30 to function as a stable rest platform or stacking/nesting support structure.

A foam material, e.g., polystyrene or polyurethane foam, is also highly preferred as the stacking support member material since it is relatively inexpensive and provides a large volume for the least amount of weight.

Although foam is a highly preferred material, it is possible to form the stacking support members 30 from other material, preferably non-metallic material. Such other materials may be selected from the group consisting of rubber, foam, wood, polyethylene, polypropylene and paper. A stacking support ring 30 made of wood or paper is respectively depicted in FIGS. 1A and 1B.

To minimize the amount of material forming the stacking support member 30, particularly if a denser material such as plastic is being utilized, it is possible to form the stacking support member with a hollowed out core. If the core of either the foam ring or other type of material is hollowed as depicted with phantom line 50 in FIG. 1, it is then preferred to form the support ring with a pair of radially inwardly and outwardly extending bands or tabs 52 Which may be adhesively secured to the lower surface 32 of the bottom wall 15. These bands or tabs 52, also depicted in phantom line, essentially provide attachment surfaces.

In accordance with another feature of the invention, the stacking support ring 30 may be colored the same color as the metal forming the can 10. For example, if the can 10 is made of aluminum, it will now be appreciated that at least the exterior surface of the foam or other material forming the stacking support rings 30 may be colored with a silver-like metallic finish to simulate the appearance of aluminum. Of course, the foam may also be colored the same color as the exterior surface of the can body 10.

Figure 2:
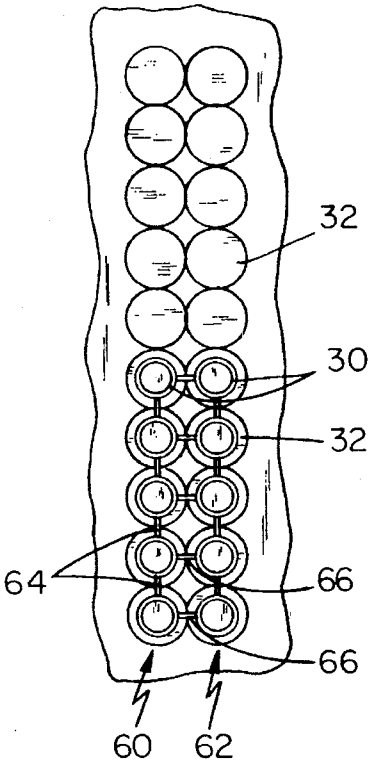
FIG. 2 is a top plan view, partly in schematic form, of a package of metal containers of FIG. 1.

FIG. 2 is an illustration of a preferred method of applying the foam rings 30 to the cans 10 after filling. In this embodiment, the foam rings 30 are formed in two parallel rows 60 and 62 wherein adjacent rings in each row are interconnected to each other with longitudinal and laterally extending tabs 64 and 66 which may also be made of foam material. These tabs 64 and 66 may be scored proximate their point of attachment to the associated foam rings 30 so as to connect the cans together to form, for example, a 6-pack or a 12-pack packaged product which may be applied to the bottom walls of the cans as they are conveyed in a two across stream for bonded attachment to the foam rings 30. A laser or hot wire may be subsequently used to sever pre-selected tabs 64 to form packages of six or twelve cans as aforesaid.

The feature of attaching stacking support rings 30 to the lower surfaces 32 of the can bottom walls 15 advantageously allows the bottom walls to be formed from very thin metal since the tensile strength of the metal itself acts to prevent deformation of the can bottom under necking, seaming, column and filling loads. The novel, flat bottom container may therefore be formed in its simplest, shape without any profile features. This has the added advantage of eliminating the need of reforming the bottom and thereby eliminating whatever potential problems are likely to occur such as when forming complex profiled features into the bottom as known in the art.

Figure 3:
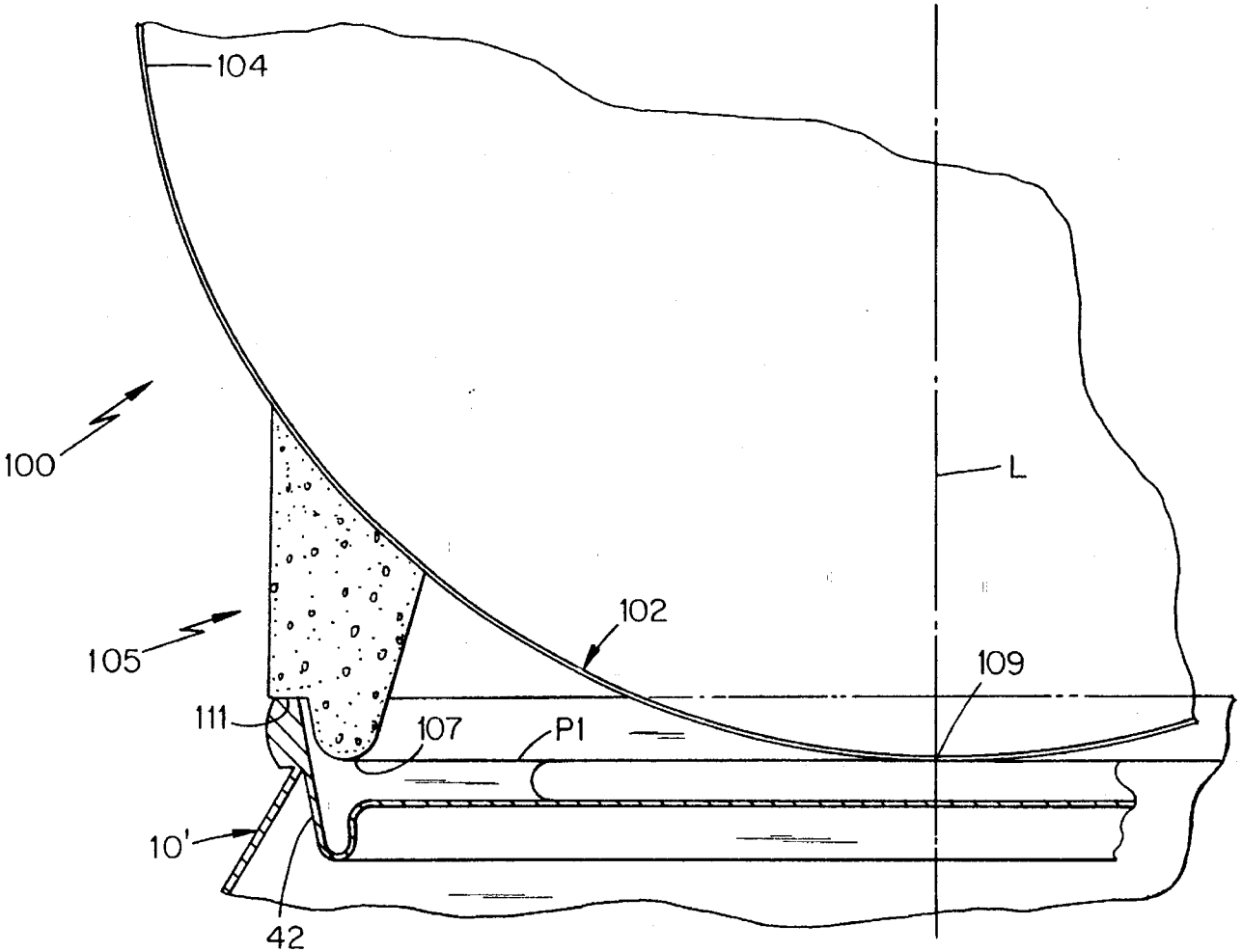
FIG. 3 is a sectional view of a second embodiment of the invention.

Notwithstanding the above description of the preferred embodiment of FIG. 1, it will now be apparent to those skilled in the art that the invention also has applicability with respect to other types of bottom shapes. For example, with reference to FIG. 3, a can body 100 may be formed with a spherical base or bottom wall 102 which extends continuously between the container cylindrical side wall 104 without any profiled nesting or stacking features in the metal bottom wall itself. This spherical base 102 also lends itself to resisting deformation under necking, sealing and filling column loading. In this embodiment, a foam rest ring 105 is bonded to project downwardly from the spherical base 102 so that a lowermost annular surface 107 of the support ring 105 will preferably lie in a plane P1 extending tangent to the center 109 of the spherical base, i.e., perpendicular to the container longitudinal axis L, for maximum stability. A nesting surface 111 may also be formed in the lower portion of the support ring 105 for location and nesting engagement with the seamed can end 42 formed on an adjacent below container 101 as depicted in FIG. 3.

Figure 4:
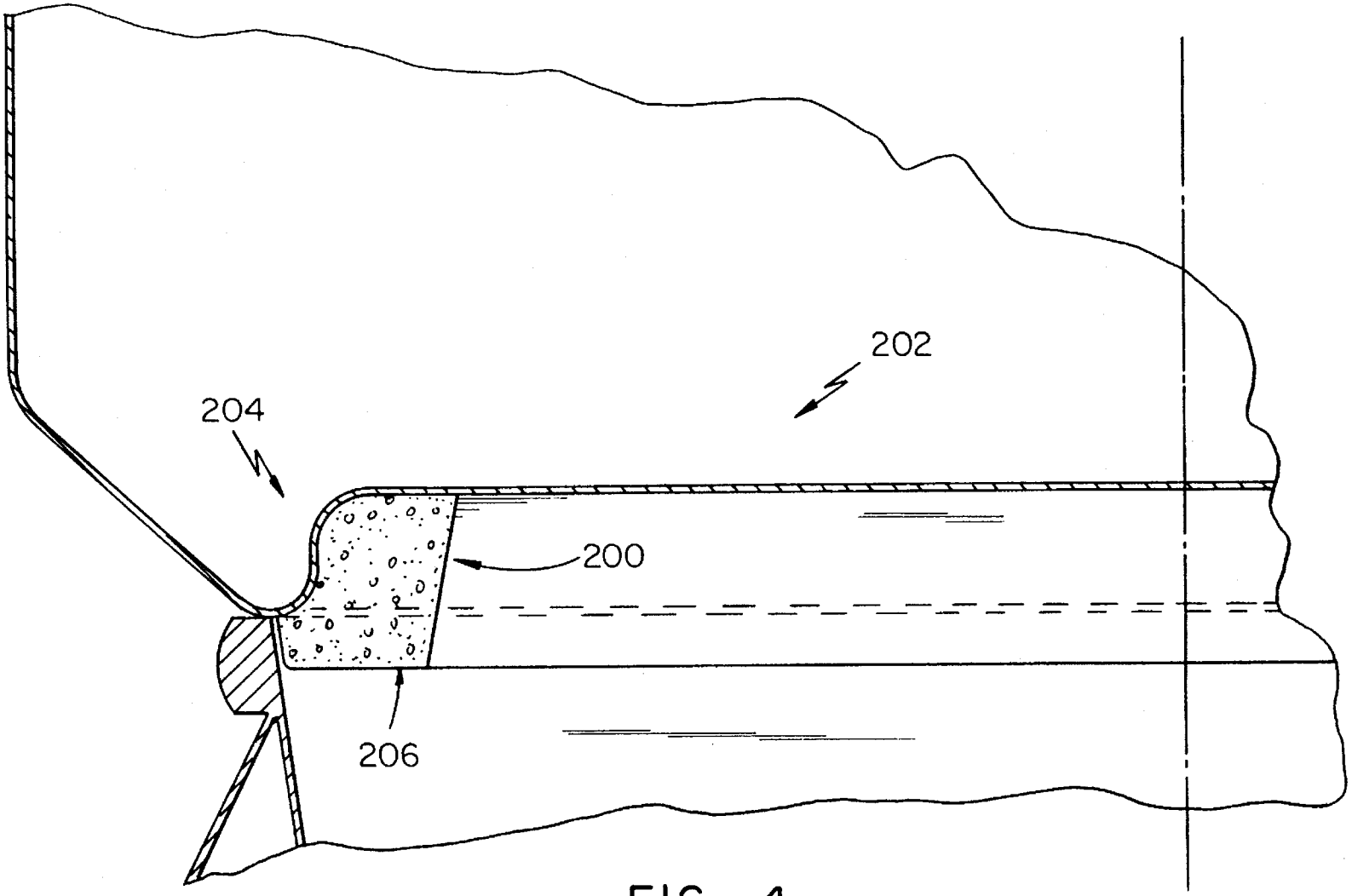
FIG. 4 is a sectional view of a third embodiment of the present invention.

FIG. 4 is an illustration of a third embodiment of the invention wherein a modified foam support ring 200 may be bonded to a conventional container bottom wall 202 formed with profiled nesting and/or stacking support features 204. In this embodiment, the foam ring 200 is preferably press-fit to extend around the radiused profiled features 204 in the container bottom wall 202 and then adhesively secured to these features. With this arrangement, it is theorized that the adhesively secured and press-fit foam ring 200 will allow for some reduction in metal gauging in view of the added resistance imparted by the foam ring to the profiled features which would tend to prevent undesirable metal reversal.

Another independent and distinct advantage of applying a foam ring 200 to a conventional container bottom 202 wherein the lowermost surface 206 of the foam ring projects downwardly from the lowermost profiled surfaces 204 of the container bottom wall, is that of providing a no-scuff bottom while also preventing 'sweating' as a result of impeding condensation transfer.

In summary, since in the preferred embodiment the container bottom wall 15 is essentially 'featureless' (i.e., there are no mechanical profiles in the bottom which are likely to 'unroll' as a result of internal pressurization), the tensile strength of the metal bottom wall 15, in combination with the unique added geometry achieved with the stacking support ring 30, is what enables the container bottom to maintain its pressure-resistant configuration since there are no features in the bottom which are subject to further pressure displacement after filling. As a result, the container bottom wall desirably may be formed with a metal thickness of less than 0.012 inch, and preferably as low as 0.0060 inch. Consequently, the present invention is believed to allow for a reduction in the amount of metal in the flat can bottom, possibly as much or greater than 30%. Of course, the feature of providing foam ring 105 or 200 in the 'non-flat' can bottoms described hereinabove, also allows for reductions in the amount of metal in the can bottoms.

While presently preferred embodiments of the invention have been illustrated and described, it will be understood that the invention is not limited thereto, but may be otherwise variously embodied within the scope of the following claims.

What is claimed is:

1. A metal container, comprising a bottom wall and a side wall extending substantially axially from the bottom wall to define an open end of the container adapted to be closed with a can end seamed onto said open end, and further including a ring permanently attached to the bottom wall to define a rest surface for supporting the container on a horizontal surface, said ring having an outer diameter less than the outer diameter of said side wall, wherein said ring further includes a nesting surface adapted to nest within an identical can end of an adjacent identical container therebelow.

2. The metal container of claim 1, wherein said bottom wall, in an unfilled and unpressurized condition, is substantially flat.

3. The metal container of claim 1, wherein, after the container has been filled with product, closed and sealed by the seaming of the can end thereon, and subjected to internal pressure, the thinness of the metal bottom wall allows a central region thereof to deform downwardly as dictated by the internal pressure.

4. The metal container of claim 1, wherein said ring is a non-metallic material.

5. The metal container of claim 1, wherein said ring is selected from the group consisting of rubber, foam, wood, polyethylene, polypropylene, polystyrene, polyurethane, and paper.

6. The metal container of claim 1, wherein said container bottom wall, in an unfilled condition, is defined by a spherical shape having a lowermost surface lying on the central longitudinal axis of the container, said stacking support member being permanently attached to the spherical surface of the bottom wall and extending downwardly to terminate in a plane extending tangent to the bottom wall lowermost surface.

7. The metal container of claim 1, wherein a stacking surface of said ring extends radially inward from the nesting surface.

8. The metal container of claim 7, wherein said ring is a circular ring.

9. The metal container of claim 7, wherein said ring has a trapezoidal cross-section.

10. The metal container of claim 8, wherein said stacking support member has a parallelogram-shaped cross-section.

11. The metal container of claim 8, wherein said bottom wall, when subjected to internal pressure, deforms downwardly into a hemispherical shape.

12. The metal container of claim 1, wherein said ring is a foam ring.

13. The metal container of claim 12, wherein said foam ring is injection molded to the bottom wall.

14. The metal container of claim 12, wherein said foam ring is pre-molded to the bottom wall with a pressure-sensitive adhesive.

15. The metal container of claim 12, wherein said foam ring is thermally bonded to the container bottom wall.

16. The metal container of claim 4, wherein an exterior surface of said stacking support member is colored to have the same appearance as the metal the container is made of.

17. A package of metal containers, comprising:

(a) plural metal containers, each container comprising a bottom wall and a side wall extending substantially axially from the bottom wall to define an open end of the container adapted to be closed with a can end seamed onto said open end, and further including a ring permanently attached to the bottom wall to define a rest surface for supporting the container on a horizontal surface, said ring having an outer diameter less than the outer diameter of said side wall, wherein said ring further includes a nesting surface adapted to nest within an identical can end of an adjacent identical container therebelow; and (b) a plurality of webs respectively interconnecting adjacent ones of said ring.

18. The package of claim 17, wherein said rings are foam rings and said webs are foam which are jointly formed with the rings as a continuous ribbon ring assembly.

* * * * *